US008965009B2

(12) United States Patent
Kim et al.

(10) Patent No.: US 8,965,009 B2
(45) Date of Patent: Feb. 24, 2015

(54) SPEAKER WITH BUILT-IN FILTER FOR DIGITAL AMPLIFIER

(71) Applicant: Neofidelity, Inc., Seoul (KR)

(72) Inventors: Soo Myung Kim, Seoul (KR); Min Soo Kim, Gwangmyeong-si (KR); Hyung Sup Yoon, Hwaseong-si (KR)

(73) Assignee: Neofidelity, Inc., Seoul (KR)

( * ) Notice: Subject to any disclaimer, the term of this patent is extended or adjusted under 35 U.S.C. 154(b) by 2 days.

(21) Appl. No.: 13/721,283

(22) Filed: Dec. 20, 2012

(65) Prior Publication Data

US 2013/0223670 A1 Aug. 29, 2013

(30) Foreign Application Priority Data

Dec. 21, 2011 (KR) ..... 10-2011-0139262

(51) Int. Cl.

| | |
|---|---|
| ***H04R 3/00*** | (2006.01) |
| ***H04R 9/02*** | (2006.01) |
| ***H04R 3/12*** | (2006.01) |
| ***H04R 9/06*** | (2006.01) |

(52) U.S. Cl.

CPC .. *H04R 9/02* (2013.01); *H04R 3/12* (2013.01); *H04R 9/06* (2013.01); *H04R 2227/003* (2013.01)

USPC ..... 381/117; 381/412; 381/433

(58) Field of Classification Search

CPC ..... H04R 3/00; H04R 2209/022; H04R 9/025

USPC ..... 381/117, 412, 433

See application file for complete search history.

(56) References Cited

U.S. PATENT DOCUMENTS

| | | | | |
|---|---|---|---|---|
| 4,243,839 | A * | 1/1981 | Takahashi et al. | 381/96 |
| 5,912,978 | A * | 6/1999 | Eastty et al. | 381/397 |
| 6,243,472 | B1 * | 6/2001 | Bilan et al. | 381/117 |
| 6,868,165 | B1 * | 3/2005 | Fabian | 381/397 |
| 7,412,071 | B2 * | 8/2008 | Wu | 381/412 |
| 2011/0188697 | A1 * | 8/2011 | Chu | 381/397 |

FOREIGN PATENT DOCUMENTS

| | | | | |
|---|---|---|---|---|
| JP | 1995-123494 | A1 | 5/1995 | |
| KR | 2004-33931 | A1 | 4/2004 | |
| KR | 2009104193 | * | 10/2009 | H04R 9/02 |

OTHER PUBLICATIONS

Korean Office Action dated Feb. 21, 2013, issued in the corresponding Korean Application No. 10-2011-0139262, by the Korean Intellectual Property Office.

* cited by examiner

*Primary Examiner* — Curtis Kuntz
*Assistant Examiner* — Ryan Robinson
(74) *Attorney, Agent, or Firm* — Stein IP, LLC

(57) ABSTRACT

A speaker with a built-in filter used for a digital amplifier is provided. The speaker with the built-in filter includes an inductor wound on an outer circumferential surface of a pillar passing through a magnet. The speaker in accordance with the present invention may be directly connected to the digital amplifier without an additional low pass filter interposed therebetween, enabling a smaller and lighter digital amplifier.

15 Claims, 12 Drawing Sheets

SPEAKER WITH BUILT-IN FILTER FOR DIGITAL AMPLIFIER

CROSS-REFERENCE TO RELATED PATENT APPLICATION

This U.S. non-provisional patent application claims priority under 35 U.S.C. §119 of Korean Patent Application No. 10-2011-0139262 filed on Dec. 21, 2011 in the Korean Intellectual Property Office, the entire contents of which are hereby incorporated by reference.

BACKGROUND OF THE INVENTION

1. Field of the Invention

The present invention relates to a speaker with a built-in filter used for a digital amplifier, and more particularly, to a speaker with a built-in filter capable of being connected directly to a digital amplifier.

2. Description of the Related Art

Advancement in digital technology has led to an increase in use of digital devices capable of playing back multimedia data. Recently, digital amplifiers are being employed in digital devices, thereby making it possible to manufacture smaller and lighter digital devices. A digital amplifier (full digital amplifier) amplifies an audio signal in digital form. By amplifying the audio signal in digital form, the digital amplifier is capable of reducing signal distortions compared to an analog amplifier. Further, the digital amplifier is more efficient and easier to be miniaturized than the analog amplifier.

FIG. 1 schematically illustrates a digital amplifier 10, a low pass filter 20 and a speaker 30 according to a prior art. Referring to FIG. 1, the digital amplifier 10 amplifies an input audio signal, and outputs the amplified audio signal to the low pass filter (LPF) 20. The low pass filter 20 converts the amplified audio signal into an analog signal, and outputs the analog signal to the speaker 30. The speaker 30 outputs the analog signal as an audio signal.

Generally, the low pass filter 20 requires an inductor and a capacitor. The inductor is bulky and heavy, which makes it difficult to manufacture smaller and lighter digital devices.

SUMMARY OF THE INVENTION

It is an object of the present invention to provide a speaker with a built-in filter capable of being connected directly to a digital amplifier.

According to an aspect of the present invention, there is provided a speaker used for a digital amplifier, including a frame; a vibration unit disposed at the frame to generate an acoustic wave; an upper plate disposed under the frame; a lower plate disposed below the upper plate; a magnet disposed between the upper plate and the lower plate; a pillar disposed between the upper plate and the lower plate by passing through the magnet; an inductor wound on an outer circumferential surface of the pillar; and a voice coil coupled to the vibration unit so as to make a piston movement by a magnetic field generated by an audio signal.

It is preferable that the vibration unit includes a cone disposed at an upper end portion of the frame, the cone being vibrated by the piston movement of the voice coil making; and a damper disposed at a lower portion of the frame, the damper being coupled to the cone.

It is preferable that the upper plate includes a ring plate having a through-hole having the voice coil passing therethrough.

It is preferable that a lower end portion of the pillar is fixedly attached to the lower plate, and an upper end portion of the pillar is inserted in the through-hole.

It is preferable that the pillar is T-shaped, and a diameter of the upper end portion of the pillar is greater than that of the lower end portion of the pillar.

It is preferable that the upper end portion of the pillar is inserted in the through-hole.

It is preferable that at least a portion of the voice coil is located in a gap between an outer circumferential surface of the upper end portion of the pillar and an inner circumferential surface of the ring plate.

It is preferable that the speaker further includes a circuit board disposed at the frame.

It is preferable that the speaker further includes a capacitor mounted on the circuit board, the capacitor being electrically connected to the inductor and the voice coil.

It is preferable that the capacitor and the voice coil are connected in parallel, and the inductor and the voice coil are connected in series.

It is preferable that the inductor includes: a first inductor wound on an upper outer circumferential surface of the pillar; and a second inductor wound on a lower outer circumferential surface of the pillar.

It is preferable that the speaker further includes a circuit board disposed at the frame.

It is preferable that the speaker further includes a capacitor mounted on the circuit board, the capacitor being electrically connected to the first inductor, the second inductor and the voice coil.

It is preferable that the capacitor and the voice coil are connected in parallel, and the first inductor, the second inductor and the voice coil are connected in series.

It is preferable that the capacitor includes a first capacitor and a second capacitor connected in series.

It is preferable that the first capacitor is connected between a first terminal of the voice coil and a ground terminal, the second capacitor is connected between the ground terminal and a second terminal of the voice coil, the first inductor is connected between a positive output terminal of the digital amplifier and the first terminal, and the second inductor is connected between a negative output terminal of the digital amplifier and the second terminal.

It is preferable that the capacitor includes: a first capacitor; a second capacitor connected to the first capacitor in series; and a third capacitor connected to the voice coil in parallel.

It is preferable that the first capacitor is connected between a first terminal of the voice coil and a ground terminal, the second capacitor is connected between the ground terminal and a second terminal of the voice coil, the third capacitor is connected between the first terminal and the second terminal, the first inductor is connected between a positive output terminal of the digital amplifier and the first terminal, and the second inductor is connected between a negative output terminal of the digital amplifier and the second terminal.

According to another aspect of the present invention, there is provided a speaker including a filter unit electrically connected to a digital amplifier, wherein the filter unit includes: an inductor wound on an outer circumferential surface of a pillar passing through a magnet of the speaker; and a capacitor disposed on a circuit board installed at a frame of the speaker, the capacitor being electrically connected to the inductor.

DETAILED DESCRIPTION OF THE PREFERRED EMBODIMENTS

Hereinafter, preferred embodiments of a speaker with a built-in filter used for a digital amplifier according to the present invention will be described in detail with reference to the accompanying drawings.

First Embodiment

Figure 1:
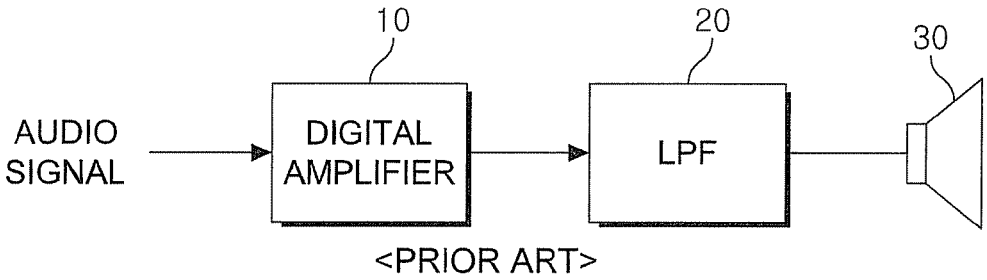
FIG. 1 is a block diagram schematically illustrating a digital amplifier, a low pass filter and a speaker according to a prior art.
Figure 2:
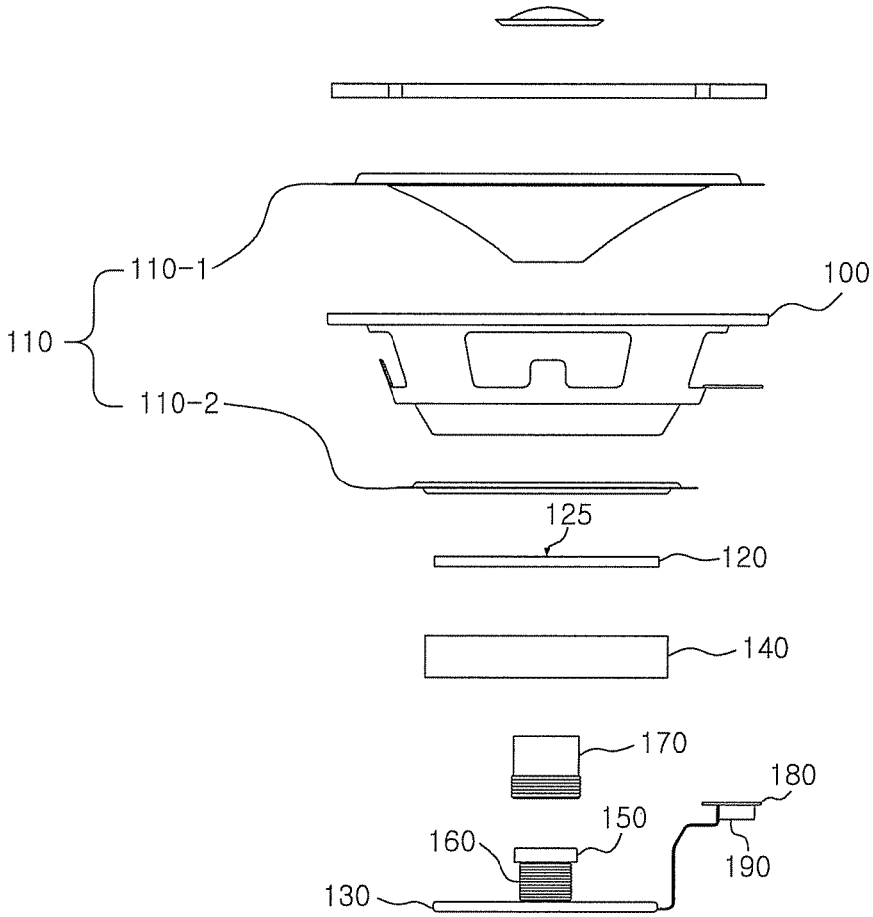
FIG. 2 is an exploded cross-sectional view of a speaker with a built-in filter used for a digital amplifier according to a first embodiment of the present invention.
Figure 3:
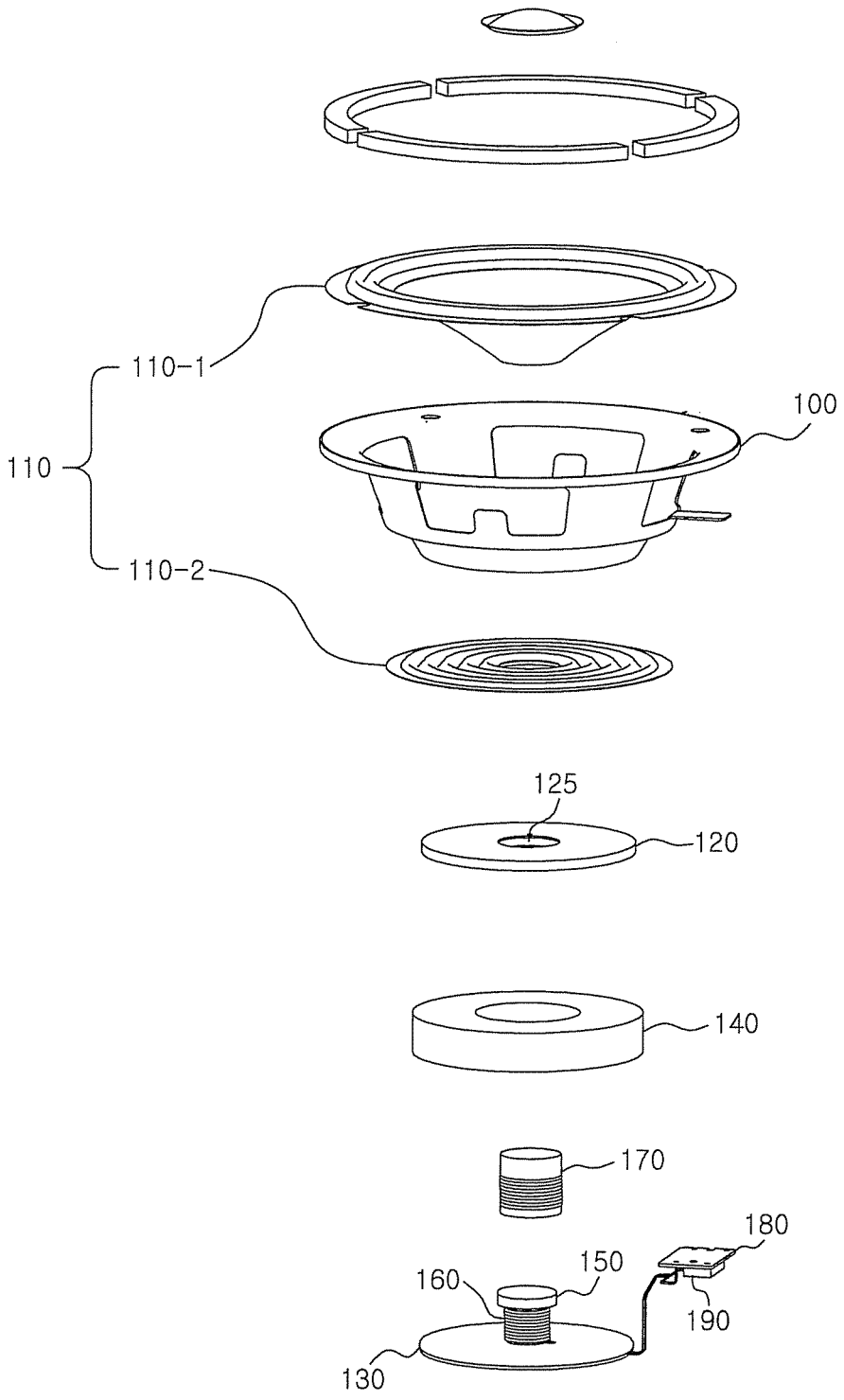
FIG. 3 is an exploded perspective view of the speaker according to the first embodiment of the present invention.
Figure 4:
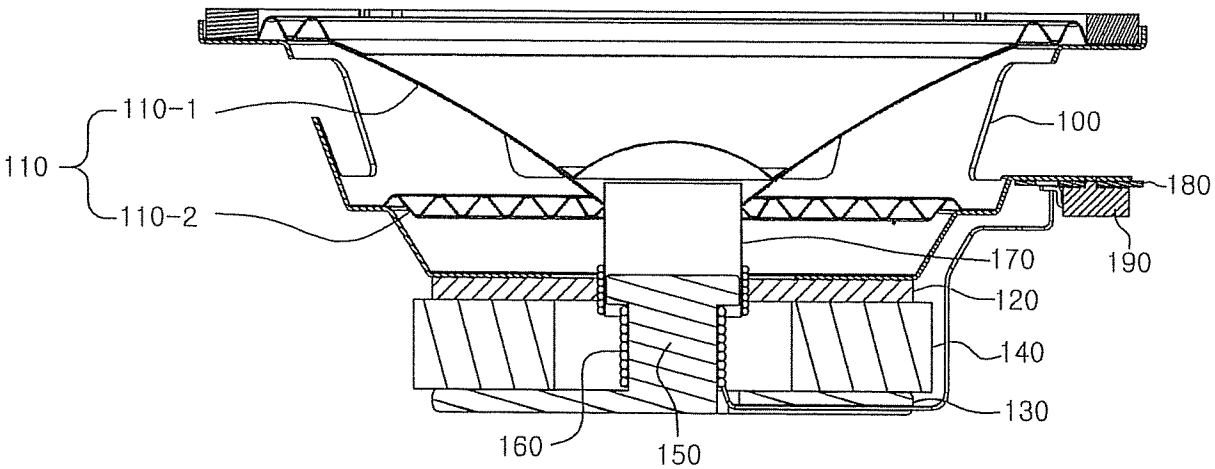
FIG. 4 is a cross-sectional view of the speaker according to the first embodiment of the present invention.

FIGS. 2 through 4 are an exploded cross-sectional view, an exploded perspective view and a cross-sectional view, respectively, of a speaker with a built-in filter used for a digital amplifier according to a first embodiment of the present invention.

Referring to FIGS. 2 through 4, the speaker according to the first embodiment includes a frame 100, a vibration unit 110, an upper plate 120, a lower plate 130, a magnet 140, a pillar 150, an inductor 160 and a voice coil 170. The speaker according to the first embodiment may further include a circuit board 180 and a capacitor 190.

The frame 100 accommodates various elements of the speaker according to the first embodiment, and constitutes an external housing of the speaker. While the frame 100 of circular basket shape is shown in FIG. 2, the present invention is not limited thereto. Frames with other shapes such as a rectangle or an oval may also be employed in the speaker according to the first embodiment. The frame 100 may be made of metal, but is not limited thereto.

The vibration unit 110 is disposed at the frame 100 and generates an acoustic wave. The vibration unit 110 includes a cone 110-1 disposed on an upper end portion of the frame 100 to be vibrated by a piston movement of the voice coil 170; and a damper 110-2 disposed at a lower portion of the frame 100 and coupled to the cone 110-1. An edge of the cone 110-1 is fixed to the frame 100 by an adhesive or the like. The cone 110-1 may be formed of paper, plastic or metal, but is not limited thereto.

The damper 110-2 is disposed at the lower portion of the frame 100, and provides a restoring force to the cone 110-1. That is, the damper 110-2 applies an elastic force onto the cone 110-1 so that the cone 110-1 may return to its original position when a vibration stops. The damper 110-2 includes a corrugated fabric disc.

The upper plate 120 is disposed below the frame 100, and may be a ring plate having a through-hole 125. The voice coil 170 is coupled to the cone 110-1 and/or the damper 110-2 via the through-hole 125.

The lower plate 130 is disposed below the upper plate 120, and is fixedly attached to a lower end portion of the pillar 150. The lower plate 130 and the pillar 150 may be formed as a single body, and made of metal, but are not limited thereto.

The magnet 140 is disposed between the upper plate 120 and the lower plate 130 to generate a magnetic field. The magnetic field from the magnet 140 enables the piston movement of the voice coil 170. The magnet 140 may be a ring-shaped ferrite magnet.

The pillar 150 is disposed between the upper plate 120 and the lower plate 130 while being inserted through a through-hole 145 of the magnet 140. Specifically, the lower end portion of the pillar 150 is fixedly attached to the lower plate 130, and an upper end portion of the pillar 150 is disposed in the through-hole 125 of the upper plate 120.

As illustrated in FIGS. 2 through 4, the pillar 150 may be a T-shaped pillar whose upper end portion has a diameter greater than that of the lower end portion thereof. In case of the pillar 150 being the T-shaped pillar, the upper end portion thereof may be disposed in the through-hole 125 of the upper plate 120.

The inductor 160 is wound on an outer circumferential surface of the pillar 150. That is, the inductor 160 is wound on an outer surface between the upper and lower end portions of the pillar 150. Both terminals of a coil that constitutes the inductor 160 may extend to the circuit board 180 through a hole 135 in the lower plate 130.

The voice coil 170 is coupled to the vibration unit 110, and makes the piston movement in an axial direction by the magnetic field from the magnet 140. Both terminals of the voice coil 170 are electrically connected to the circuit board 180.

At least a portion (e.g., a lower end portion) of the voice coil 170 is disposed in a gap between an upper end portion of the outer circumferential surface of the pillar 150 and an inner circumferential surface of the upper plate 120 which is the ring plate.

The speaker according to the first embodiment may further include the circuit board 180 and the capacitor 190.

The circuit board 180 is disposed at a side of the frame 100, and is electrically connected to the inductor 160 and the voice coil 170. The circuit board 180 includes conductive patterns (not shown) on a surface thereof which electrically connects circuit elements such as the inductor 160 and the capacitor 190.

Figure 7:
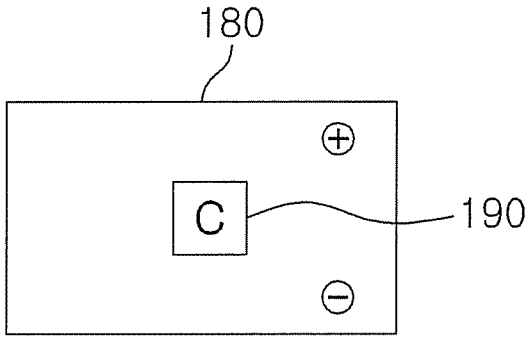
FIG. 7 is a diagram schematically illustrating a circuit board in the speaker according to the first embodiment of the present invention.

As illustrated in FIG. 7, the capacitor 190 is disposed on the circuit board 180, and is electrically connected to the inductor 160, thereby constituting the filter unit.

The filter unit including the inductor 160 and the capacitor 190 in the speaker according to the first embodiment will now be described in detail with reference to FIGS. 5 and 6.

Figure 5:
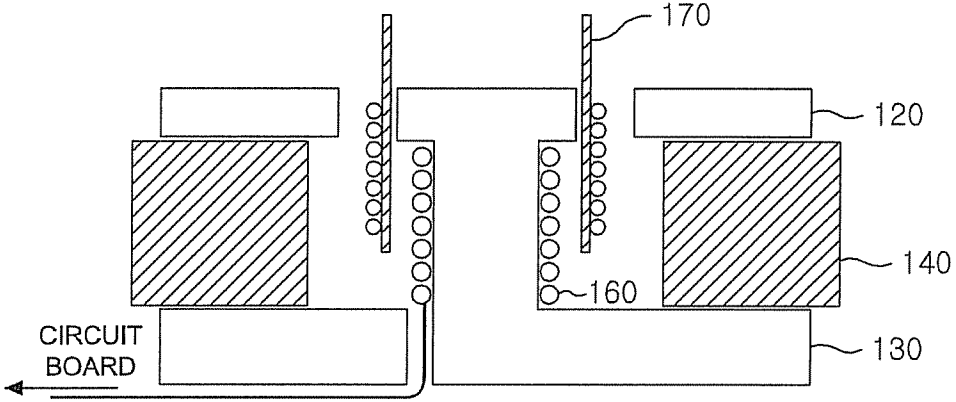
FIG. 5 is a cross-sectional view of an inductor in the speaker according to the first embodiment of the present invention.

FIG. 5 is a cross-sectional view of the inductor 160 in the speaker according to the first embodiment of the present invention.

Referring to FIG. 5, the inductor 160 is wound on the outer circumferential surface of the pillar 150. The both terminals of the coil that constitutes the inductor 160 preferably extend to the circuit board 180 via the hole 135 in the lower plate 130, and are electrically connected to the capacitor 190 mounted on the circuit board 180.

Figure 6:
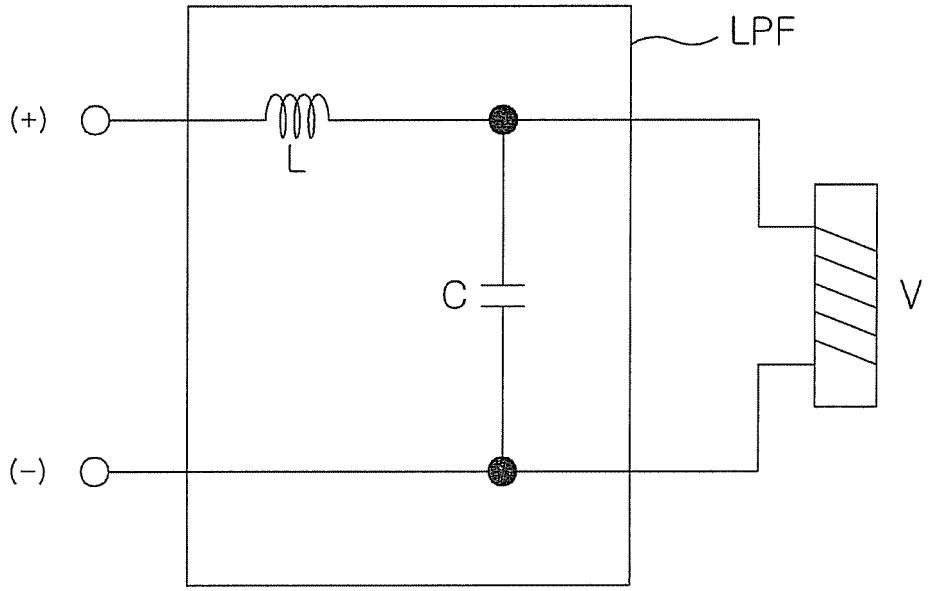
FIG. 6 is a circuit diagram of a filter unit in the speaker according to the first embodiment of the present invention.

FIG. 6 is a circuit diagram of the filter unit in the speaker according to the first embodiment of the present invention.

Referring to FIG. 6, a filter unit LPF includes an inductor L and a capacitor C. A positive output terminal of a digital amplifier (not shown) is connected to a first terminal of the inductor L, and a negative output terminal of the digital amplifier is connected to a second terminal of the capacitor C and a second terminal of a voice coil V. A second terminal of the inductor L and a first terminal of the capacitor C are connected to a first terminal of the voice coil V. That is, the capacitor C and the voice coil V are connected in parallel, and the inductor L and the voice coil V are connected in series. The inductor L corresponds to the inductor 160 which is disposed on the outer circumferential surface of the pillar 150. The capacitor C corresponds to the capacitor 190 which is mounted on the circuit board 180. The voice coil V corresponds to the voice coil 170 which is coupled to the vibration unit 110.

Second Embodiment

Figure 8:
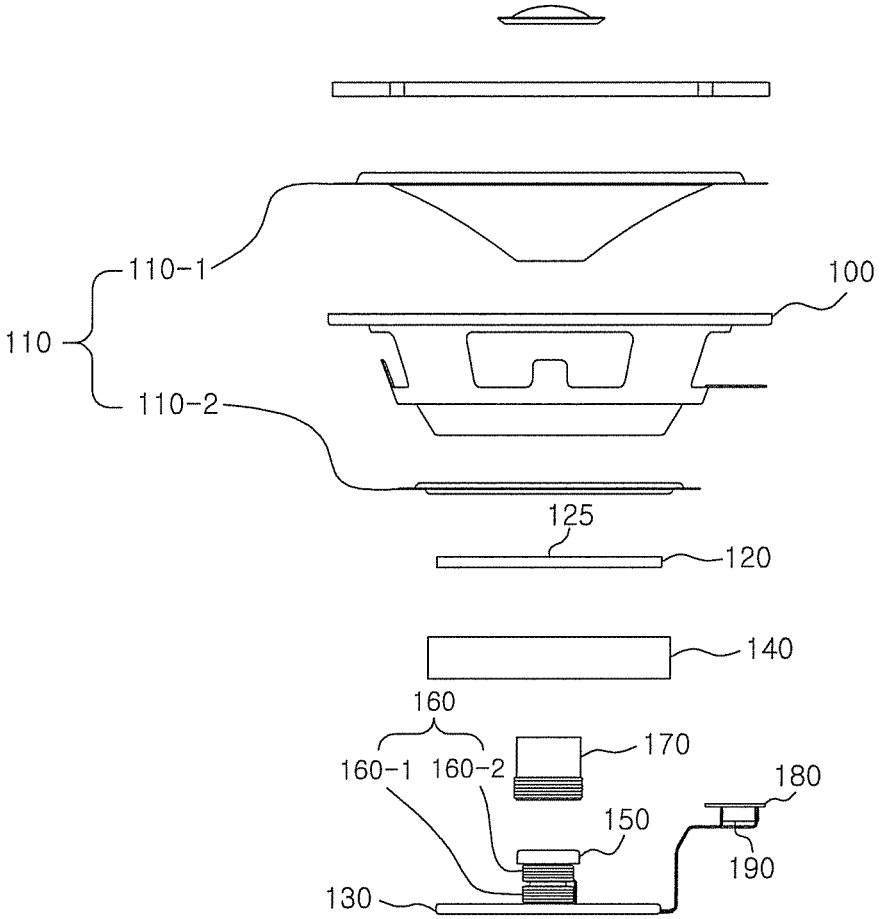
FIG. 8 is an exploded cross-sectional view of a speaker with a built-in filter used for a digital amplifier according to a second embodiment of the present invention.
Figure 9:
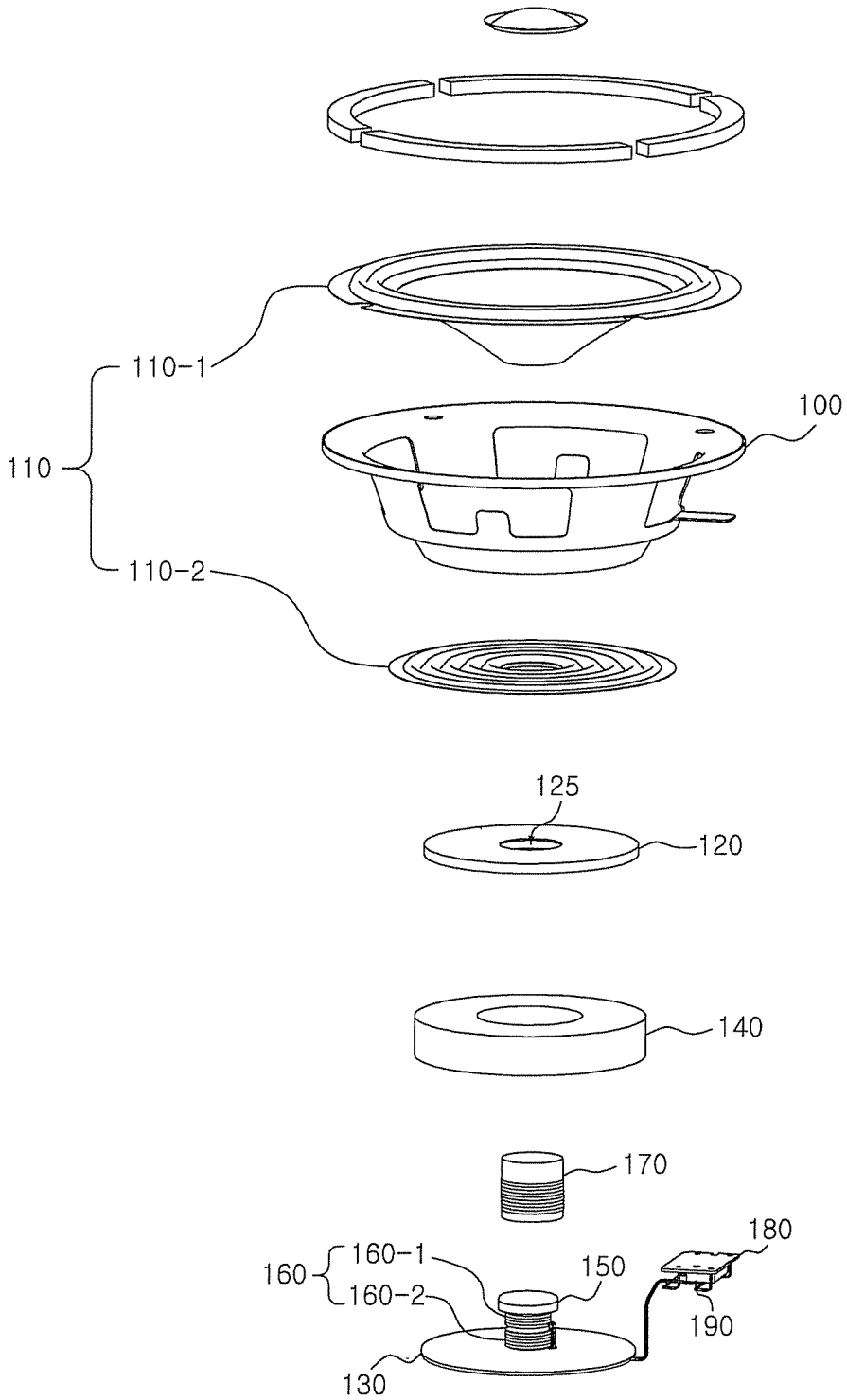
FIG. 9 is an exploded perspective view of the speaker according to the second embodiment of the present invention.
Figure 10:
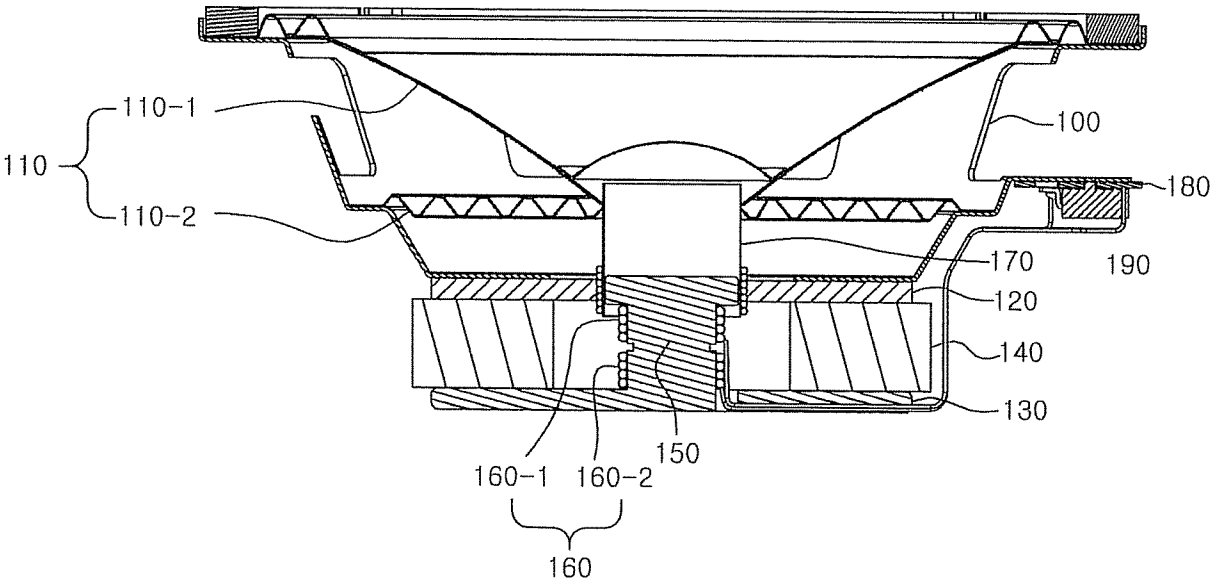
FIG. 10 is a cross-sectional view of the speaker according to the second embodiment of the present invention.

FIGS. 8 through 10 are an exploded cross-sectional view, an exploded perspective view and a cross-sectional view, respectively, of a speaker with a built-in filter used for a digital amplifier according to a second embodiment of the present invention.

Referring to FIGS. 8 through 10, the speaker according to the second embodiment includes a frame 100, a vibration unit 110, an upper plate 120, a lower plate 130, a magnet 140, a pillar 150, an inductor 160 and a voice coil 170. The speaker according to the second embodiment may further include a circuit board 180 and a capacitor 190.

The speaker according to the second embodiment is same as that of the first embodiment except for the inductor 160. Therefore, the inductor 160, the circuit board 180 and the capacitor 190 will now be described in detail, and the descriptions of the frame 100, the vibration unit 110, the upper plate 120, the lower plate 130, the magnet 140, the pillar 150 and the voice coil 170 will be omitted.

Figure 11:
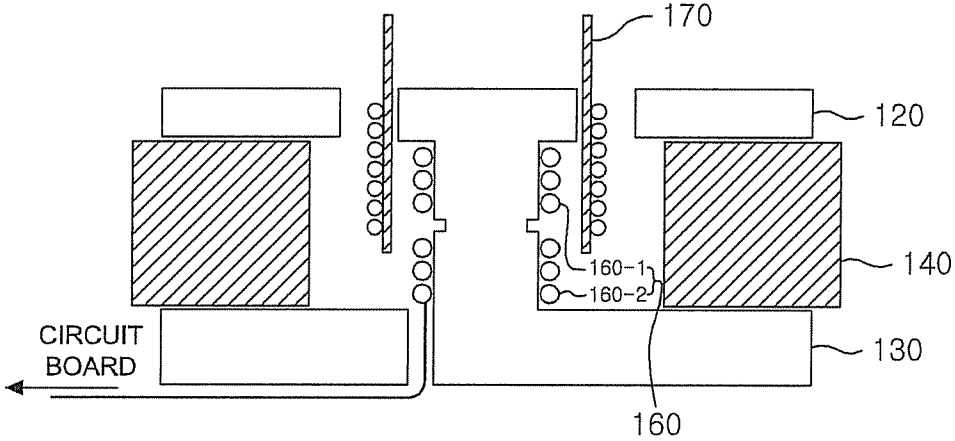
FIG. 11 is a cross-sectional view of an inductor in the speaker according to the second embodiment of the present invention.

As illustrated in FIG. 11, the inductor 160 is wound on an outer circumferential surface of the pillar 150. The inductor 160 includes a first inductor 160-1 and a second inductor 160-2.

The first inductor 160-1 is wound on an upper outer circumferential surface of the pillar 150, and the second inductor 160-2 is wound on a lower outer circumferential surface of the pillar 150. Both terminals of each of coils that constitute the first inductor 160-1 and the second inductor 160-2 preferably extend to the circuit board 180 through a hole 135 in the lower plate 130.

The speaker according to the second embodiment may further include the circuit board 180 and the capacitor 190. The circuit board 180 is disposed at a side of the frame 100, and is electrically connected to the first inductor 160-1, the second inductor 160-2 and the voice coil 170. The circuit board 180 includes conductive patterns (not shown) on a surface thereof which electrically connects circuit elements such as the first inductor 160-1, the second inductor 160-2 and the capacitor 190.

As illustrated in FIG. 7, the capacitor 190 is mounted on the circuit board 180, and is electrically connected to the first inductor 160-1 and the second inductor 160-2, thereby constituting a filter unit.

The filter unit including the first inductor 160-1, the second inductor 160-2 and the capacitor 190 in the speaker according to the second embodiment will now be described in detail with reference to FIGS. 11 and 12.

FIG. 11 is a cross-sectional view of the first inductor and the second inductor in the speaker according to the second embodiment of the present invention.

Referring to FIG. 11, the first inductor 160-1 is wound on the upper outer circumferential surface of the pillar 150, and the second inductor 160-2 is wound on the lower outer circumferential surface of the pillar 150. Both terminals of each of coils that constitute the first inductor 160-1 and the second inductor 160-2 preferably extend the circuit board 180 through the hole 135 in the lower plate 130, and are electrically connected to the capacitor 190 mounted on the circuit board 180.

Figure 12:
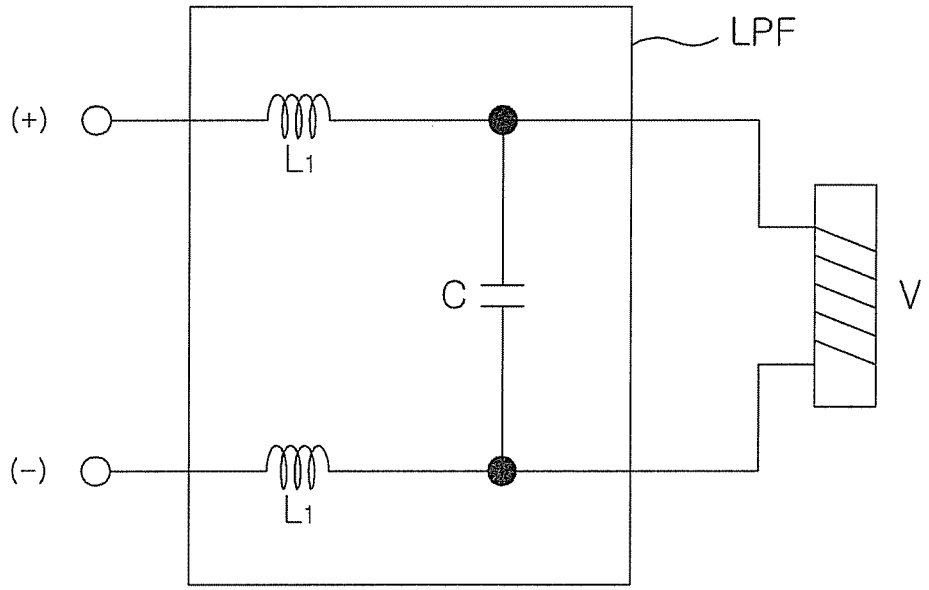
FIG. 12 is a circuit diagram of a filter unit in the speaker according to the second embodiment of the present invention.

FIG. 12 is a circuit diagram of a filter unit of the speaker according to the second embodiment of the present invention.

Referring to FIG. 12, a filter unit LPF includes two inductors $L_1$ and $L_2$ and a capacitor C. A positive output terminal of a digital amplifier (not shown) is connected to a first terminal of the first inductor $L_1$, and a negative output terminal of the digital amplifier is connected to a first terminal of the second inductor $L_2$. A second terminal of the first inductor $L_1$ is connected to a first terminal of the capacitor C and a first terminal of a voice coil V. A second terminal of the second inductor $L_2$ is connected to a second terminal of the capacitor C and a second terminal of the voice coil V. That is, the capacitor C and the voice coil V are connected in parallel, and the first inductor $L_1$, the second inductor $L_2$ and the voice coil V are connected in series. The first inductor $L_1$ and the second inductor $L_2$ correspond to the first inductor 160-1 and the second inductor 160-2, respectively. The first inductor $L_1$ and the second inductor $L_2$ are disposed on the upper and the lower outer circumferential surfaces of the pillar 150, respectively. The capacitor C corresponds to the capacitor 190 which is mounted on the circuit board 180. The voice coil V corresponds to the voice coil 170 which is coupled to the vibration unit 110.

Third Embodiment

Figure 13:
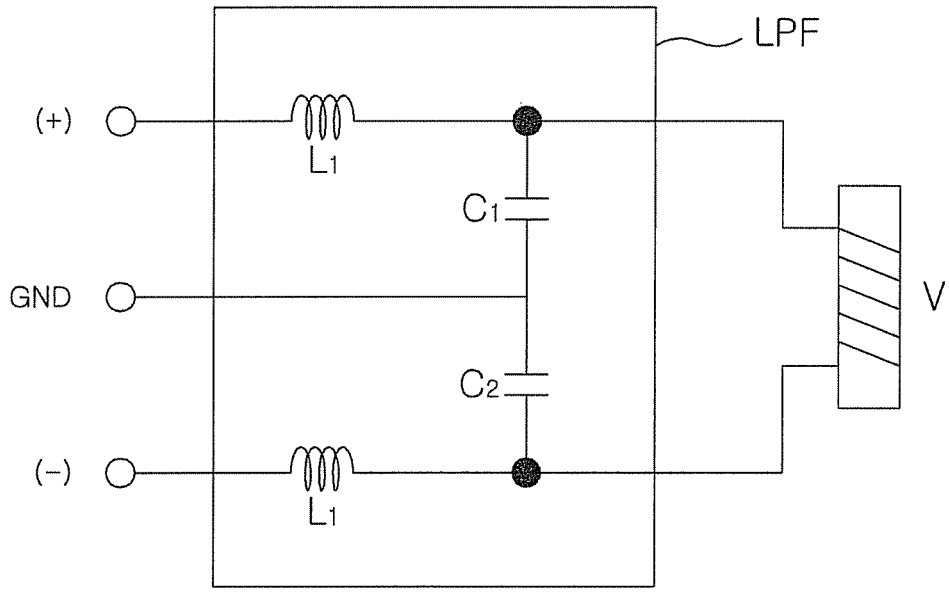
FIG. 13 is a circuit diagram of a filter unit in a speaker with a built-in filter used for a digital amplifier according to a third embodiment of the present invention.
Figure 14:
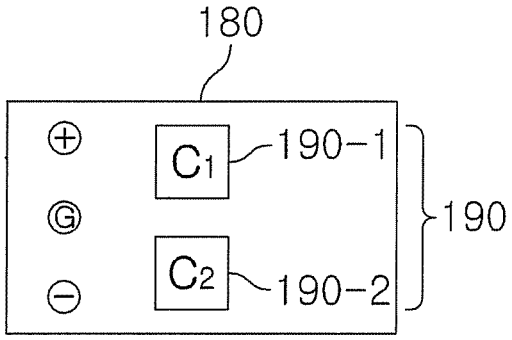
FIG. 14 is a diagram schematically illustrating a circuit board in the speaker according to the third embodiment of the present invention.

FIG. 13 illustrates a circuit diagram of a speaker with a built-in filter used for a digital amplifier, and FIG. 14 schematically illustrates a diagram of a circuit board in the speaker according to a third embodiment of the present invention. The speaker according to the third embodiment is same as that of the second embodiment except for the capacitor 190. Therefore, the circuit board 180 and the capacitor 190 will be described in detail, and the descriptions of the frame 100, the vibration unit 110, the upper plate 120, the lower plate 130, the magnet 140, the pillar 150, the inductor 160 and the voice coil 170 will be omitted.

An inductor in the speaker according to the third embodiment includes a first inductor and a second inductor same as the inductor 160 in the speaker according to the second embodiment.

The speaker according to the third embodiment may further include a circuit board 180 and a capacitor 190. The circuit board 180 is disposed at a side of a frame, and is electrically connected to the first inductor, the second inductor and a voice coil V. The circuit board 180 includes conductive patterns (not shown) on a surface thereof which electrically connects circuit elements such as the first inductor, the second inductor, a first capacitor 190-1 and a second capacitor 190-2.

As illustrated in FIG. 14, the capacitor 190 includes the first capacitor 190-1 and the second capacitor 190-2 which are mounted on the circuit board 180. The first capacitor 190-1 and the second capacitor 190-2 are electrically connected to the first inductor $L_1$ and the second inductor $L_2$, thereby constituting the filter unit.

FIG. 13 is a circuit diagram of the filter unit in the speaker according to the third embodiment of the present invention. Referring to FIG. 13, a filter unit LPF includes two inductors $L_1$ and $L_2$ and two capacitors $C_1$ and $C_2$.

As illustrated in FIG. 13, the first capacitor $C_1$ is connected between a first terminal of the voice coil V and a ground terminal. The second capacitor C is connected between the ground terminal and a second terminal of the voice coil V. The first inductor $L_1$ is connected between a positive output terminal of the digital amplifier and the first terminal of the voice coil V. The second inductor $L_2$ is connected between a negative output terminal of the digital amplifier and the second terminal of the voice coil V. The first and second inductors $L_1$ and $L_2$ correspond to the first and second inductors 160-1 and 160-2, respectively. The capacitors $C_1$ and $C_2$ correspond to the first capacitor 190-1 and the second capacitor 190-2, respectively which are mounted on the circuit board 180. The voice coil V corresponds to the voice coil 170 which is coupled to the vibration unit 110.

Fourth Embodiment

Figure 15:
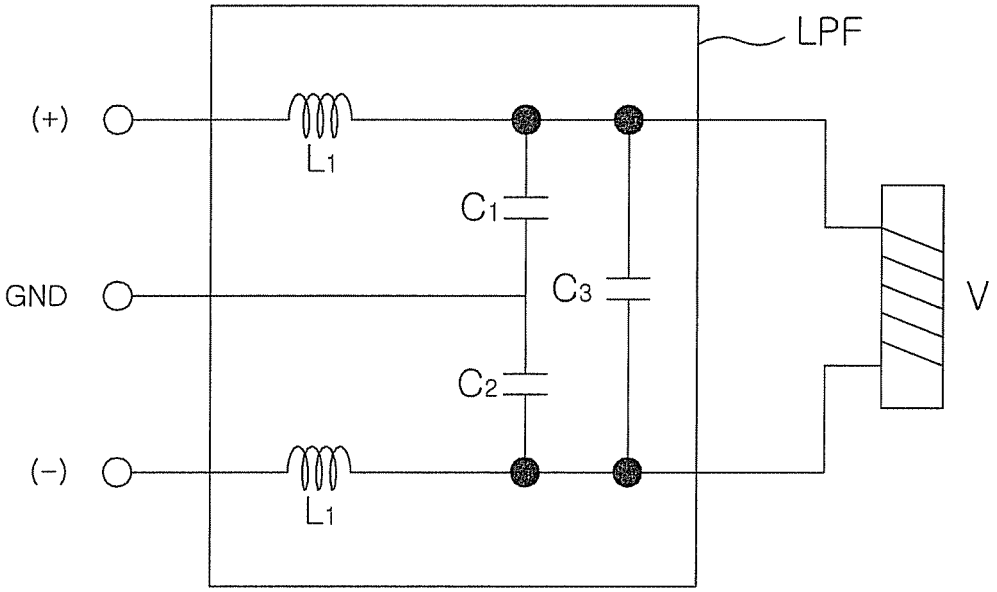
FIG. 15 is a circuit diagram of a filter unit in a speaker with a built-in filter used for a digital amplifier according to a fourth embodiment of the present invention.
Figure 16:
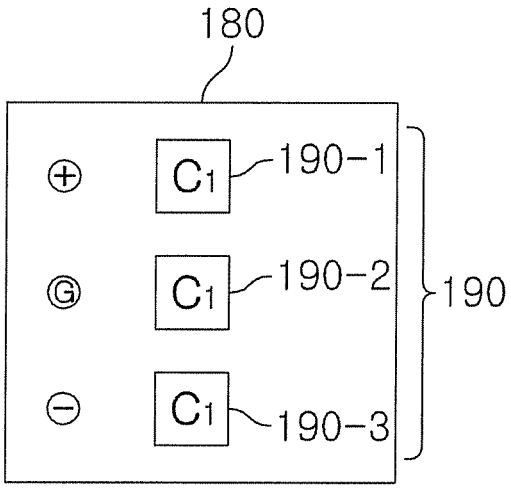
FIG. 16 is a diagram schematically illustrating a circuit board in the speaker according to the fourth embodiment of the present invention.

FIG. 15 illustrates a circuit diagram of a speaker with a built-in filter used for a digital amplifier, and FIG. 16 schematically illustrates a diagram of a circuit board in the speaker according to a fourth embodiment of the present invention.

The speaker according to the fourth embodiment is same as that of the second embodiment except for the capacitor 190. Therefore, the circuit board 180 and the capacitor 190 will be described in detail, and the descriptions of the frame 100, the vibration unit 110, the upper plate 120, the lower plate 130, the magnet 140, the pillar 150, the inductor 160 and the voice coil 170 will be omitted.

An inductor 160 in the speaker according to the fourth embodiment includes a first inductor $L_1$ and a second inductor $L_2$ same as the inductor 160 in the speaker according to the second embodiment.

The speaker according to the fourth embodiment may further include the circuit board 180 and the capacitor 190. The circuit board 180 is disposed at a side of a frame, and is electrically connected to the first inductor $L_1$ (corresponding to the first inductor 160-1 of FIG. 8), the second inductor $L_2$ (corresponding to the second inductor 160-2 of FIG. 8) and a voice coil V. The circuit board 180 includes conductive patterns (not shown) on a surface thereof which electrically connects circuit elements such as the first inductor $L_1$, the second inductor $L_2$, a first capacitor 190-1, a second capacitor 190-2 and a third capacitor 190-3.

As illustrated in FIG. 16, the capacitor 190 includes the first capacitor 190-1, the second capacitor 190-2 and the third capacitor 190-3 which are mounted on the circuit board 180. The first capacitor 190-1, the second capacitor 190-2 and the third capacitor 190-3 are electrically connected to the first inductor $L_1$ and the second inductor $L_2$, thereby constituting the filter unit.

FIG. 15 is a circuit diagram of the filter unit in the speaker according to the fourth embodiment of the present invention.

Referring to FIG. 15, a filter unit LPF includes two inductors $L_1$ and $L_2$ and three capacitors $C_1$, $C_2$ and $C_3$.

As illustrated in FIG. 15, the first capacitor $C_1$ is connected between a first terminal of the voice coil V and a ground terminal. The second capacitor $C_2$ is connected between the ground terminal and a second terminal of the voice coil V. The third capacitor $C_3$ is connected between the first and second terminals of the voice coil V. The first inductor $L_1$ is connected between a positive output terminal of the digital amplifier and the first terminal of the voice coil V. The second inductor $L_2$ is connected between a negative output terminal of the digital amplifier and the second terminal of the voice coil V. The first inductor $L_1$ and the second inductor $L_2$ correspond to the first inductor 160-1 and the second inductor 160-2, respectively. The first to third capacitors $C_1$, $C_2$ and $C_3$ correspond to the first capacitor 190-1, the second capacitor 190-2 and the third capacitor 190-3, respectively, which are mounted on the circuit board 180. The voice coil V corresponds to the voice coil 170 which is coupled to the vibration unit 110.

By employing the speaker with a built-in filter according to the present invention, it is possible to manufacture smaller and lighter digital devices. In particular, a space for an inductor can be saved by wounding the inductor on the pillar in the speaker. Further, the speaker according to the present invention includes a low pass filter embedded therein, so that it can be connected directly to a digital amplifier. Therefore, in accordance with the speaker of the present invention, digital devices can be made smaller and lighter to enhance user convenience.

What is claimed is:

1. A speaker used for a digital amplifier, comprising:

a frame;

a vibration unit disposed at the frame to generate an acoustic wave;

an upper plate disposed under the frame;

a lower plate disposed below the upper plate;

a magnet disposed between the upper plate and the lower plate;

a pillar disposed between the upper plate and the lower plate by passing through the magnet;

a voice coil coupled to the vibration unit so as to make a piston movement by a magnetic field generated by an analog audio signal; and a low pass filter configured to convert a digital audio signal outputted from the digital amplifier to the analog audio signal, wherein the low pass filter comprises:

an inductor wound on an outer circumferential surface of the pillar below the voice coil; and a capacitor mounted on a circuit board and electrically connected to the inductor.

2. The speaker of claim 1, wherein the vibration unit comprises:

a cone disposed at an upper end portion of the frame, the cone being vibrated by the piston movement of the voice coil; and a damper disposed at a lower portion of the frame, the damper being coupled to the cone.

3. The speaker of claim 1, wherein the upper plate comprises a ring plate having a through-hole having the voice coil passing therethrough.

4. The speaker of claim 3, wherein a lower end portion of the pillar is fixedly attached to the lower plate, and an upper end portion of the pillar is inserted in the through-hole.

5. The speaker of claim 3, wherein the pillar is T-shaped, and a diameter of the upper end portion of the pillar is greater than that of the lower end portion of the pillar.

6. The speaker of claim 5, wherein the upper end portion of the pillar is inserted in the through-hole.

7. The speaker of claim 4, wherein at least a portion of the voice coil is located in a gap between an outer circumferential surface of the upper end portion of the pillar and an inner circumferential surface of the ring plate.

8. The speaker of claim 1, wherein the circuit board is disposed at the frame.

9. The speaker of claim 1, wherein the capacitor is electrically connected to the voice coil.

10. The speaker of claim 9, wherein the capacitor and the voice coil are connected in parallel, and the inductor and the voice coil are connected in series.

11. A speaker used for a digital amplifier, comprising:

a frame;

a vibration unit disposed at the frame to generate an acoustic wave;

an upper plate disposed under the frame;

a lower plate disposed below the upper plate;

a magnet disposed between the upper plate and the lower plate;

a pillar disposed between the upper plate and the lower plate by passing through the magnet;

an inductor wound on an outer circumferential surface of the pillar, wherein the inductor comprises: a first inductor wound on an upper outer circumferential surface of the pillar; and a second inductor wound on a lower outer circumferential surface of the pillar;

a voice coil coupled to the vibration unit so as to make a piston movement by a magnetic field generated by an audio signal;

a circuit board disposed at the frame;

a capacitor mounted on the circuit board, the capacitor being electrically connected to the first inductor, the second inductor and the voice coil, wherein the capacitor comprises a first capacitor and a second capacitor connected in series.

12. The speaker of claim 11, wherein the first capacitor is connected between a first terminal of the voice coil and a ground terminal, the second capacitor is connected between the ground terminal and a second terminal of the voice coil, the first inductor is connected between a positive output terminal of the digital amplifier and the first terminal, and the second inductor is connected between a negative output terminal of the digital amplifier and the second terminal.

13. The speaker of claim 11, wherein the capacitor further comprises:

a third capacitor connected to the voice coil in parallel.

14. The speaker of claim 13, wherein the first capacitor is connected between a first terminal of the voice coil and a ground terminal, the second capacitor is connected between the ground terminal and a second terminal of the voice coil, the third capacitor is connected between the first terminal and the second terminal, the first inductor is connected between a positive output terminal of the digital amplifier and the first terminal, and the second inductor is connected between a negative output terminal of the digital amplifier and the second terminal.

15. The speaker of claim 11, wherein the capacitor and the voice coil are connected in parallel, and the first inductor, the second inductor and the voice coil are connected in series.

* * * * *